US009975010B2

(12) United States Patent
Saso

(10) Patent No.: US 9,975,010 B2
(45) Date of Patent: May 22, 2018

(54) GOLF-CLUB PROVIDED WITH A CLUB-HEAD HAVING SURFACES CONFIGURED TO BE COVERED BY AIR VORTEX FLOWS

(71) Applicant: CROSS TECHNOLOGY LABO CO., LTD., Fukushima (JP)

(72) Inventor: Mitsuhiro Saso, Hyogo (JP)

(73) Assignee: CROSS TECHNOLOGY LABO CO., LTD., Aizuwakamatsu-Shi, Fukushima (JP)

( * ) Notice: Subject to any disclaimer, the term of this patent is extended or adjusted under 35 U.S.C. 154(b) by 0 days. days.

(21) Appl. No.: 15/170,455

(22) Filed: Jun. 1, 2016

(65) Prior Publication Data

US 2017/0312591 A1 Nov. 2, 2017

(30) Foreign Application Priority Data

Apr. 28, 2016 (JP) ..... 2016-090809

(51) Int. Cl.
*A63B 53/04* (2015.01)
*A63B 60/00* (2015.01)

(52) U.S. Cl.
CPC .. *A63B 53/0466* (2013.01); *A63B 2053/0433* (2013.01); *A63B 2053/0437* (2013.01); *A63B 2053/0445* (2013.01); *A63B 2060/006* (2015.10)

(58) Field of Classification Search
CPC ..... A63B 53/0466
See application file for complete search history.

(56) References Cited

U.S. PATENT DOCUMENTS 5,524,890 A * 6/1996 Kim ..... A63B 53/04 473/242
D382,612 S * 8/1997 Oyer ..... D21/752
D501,903 S * 2/2005 Tanaka ..... D21/752
8,608,587 B2 * 12/2013 Henrikson ..... A63B 53/0466 473/324

FOREIGN PATENT DOCUMENTS

JP S60-128664 U 8/1985
JP H06-7484 A 1/1994

* cited by examiner

*Primary Examiner* — Michael Dennis
(74) *Attorney, Agent, or Firm* — IP Business Solutions, LLC

(57) ABSTRACT

This invention provides a golf club with a club-head configured so as to decrease air resistance of the head by avoiding the air flows from retouching on the head surface. The club-head is provided with a ridge structure which contains a first ridge and a second ridge arranged at intervals in a downward direction of the air flows on at least the sole part of the head, wherein each of the ridges has the height of 0.2 mm to 3 mm and the breadth of 1 mm to 5 mm, the ridge structure being configured by plural ridges so as to displace the inclined angle of the ridges in a clockwise direction, resulting in generation of air vortex or whirls between the head surface and the surrounding air flows as shown in FIG. 2.

5 Claims, 7 Drawing Sheets

GOLF-CLUB PROVIDED WITH A CLUB-HEAD HAVING SURFACES CONFIGURED TO BE COVERED BY AIR VORTEX FLOWS

THE TECHNICAL FIELD OF THE INVENTION

This invention relates to a wood-type golf-club provided with a club-head having surfaces which are configured to be covered by air vortex flows or whirls, especially in order to decrease air resistance on the club-head during swinging wherein air vortex flows are generated by motions of air flows crashing against walls of ridge structures on a head surface, which are made of partitions such as linear protrusions.

THE BACKGROUND OF THE INVENTION

In golf playing, a long driving distance needs much more swing speed and thus the head air resistance during swing should be decreased as much as possible. For this object, it has been proposed a driver provided with a club-head made in a general shape of flattered cannonball having an isosceles triangle in the flat (the patent document 1). However, the thickness limitation of the flattered club-head could not make the air resistance smaller more than expected.

Generally vortex generated at the rear of the head causes the air resistance larger than any others, so that It has been also proposed to form a plurality of dimples on the crown part behind the burble point positioned at the middle of the head in order to decrease air turbulence behind the burble point. (the patent document 2).

THE PRIOR ART OF THE INVENTION

[The patent literature 1] Japanese Utility model publication 1987-128664

[The patent literature 2] Japanese Patent publication 1994-7484

THE SUMMARY OF THE INVENTION

From the air flows as shown in FIG. 1(*c*) which was done by wind-tunnel research, the inventor focused on the air flow dynamics around the club-head. The air generally moves in laminar flows on the head surface and the air flows tend to peel out just behind the top of the crown and afterward becomes turbulent. This causes the air resistance og the head. However, in the light of trajectory pattern of the club head during swing from the top position through down-swing to the impact position as shown in FIG. 1(*a*), the air resistance of the head would be made dominantly by contacting the sole face of the head with the surrounding air, because the head face just becomes square to the ball just only before and after the impact point while the crown and sole parts of the head always are contacting with the surrounding air. From this, the known formation of dimples on the rear part of the crown would be supposed not to be effective to decrease the air resistance. In the light of the vector of the down-swing, the angle difference between a shaft line A to B against a line B-G would causes toe-down of the head at the time of impact as well as twist of the shaft would causes toe-in of the head at the time of impact, wherein the grip is B, the shaft edge is A while the head gravity is G. Heretofore, movement trial for the gravity of the head from the toe point to the heel point has been proposed to avoid the toe-down and tor-in phenomenon.

After our sharp researches, we found that the both phenomenon would be caused dominantly by the air resistance of the head, not only by the gravity position of the head. Further, from the sight of the head vector pattern, the inventor also found that the air resistance would be dominantly caused by the sole part which is contacting stickly to the surrounding air, so that it has been found that the most important point is to decrease the air resistance caused by the sole part of the head.

The Means to Solve the Problem

In the light of the findings, the inventor has come to an aero dynamic concept that the existence of the air layer between the head surface and the surrounding air flow would help to avoid the surrounding air from stickingly contacting to the head surface and causing the air resistance. this invention has been made on the basis of the aero dynamic concept. According to the invention, a new golf-club can be provided. The new golf-club is provided with a head having a ridge structure on at least a sole part of the head, which comprises a first ridge or linear projection and a second ridge or linear projection arranged at intervals in a downward direction of the air flow wherein the first ridge receives the air flows surrounding the head as a barrier and the air flows crash against walls of the first ridge and then cross over the first ridges, afterward enter into a space in front of the second ridge and crash again against front walls of the second ridge. The repeat of the above successive actions would make reverse flows and air whirls in the spaces between the first and second ridges.

The ridge structure according to the present invention is configured to make air vortex flows or whirls W as shown in FIG. 3, concretely by steps of 1) making the air flows to crash against a first ridge R1 projected on the sole surface of the head, 2) making the air flows to cross over the first ridge R1, 3) then making the air flows to crash again against a second ridge arranged in a downstream and to make a reverse air flows in a direction of the upstream. In the light of the vector pattern of the club swing from the top position to the impact position as shown in FIG. 1(*a*), it is understood that the sole part is moving so as to displace the face angle in a counterclockwise direction, so that each of the second ridges is preferred to have an angle distribution in a crockwise direction in relation to the first ridge. Therefore the second ridges are arranged outwardly in a radial fashion to the first ridges, so that the first and the second ridges partition spaces where air vortex flows or whirls can be made by the motion of air flow crashing against the ridges. Based on the theory, according to a first embodiment of the present invention, the sole surface is configured to have a ridge structure provided with partitions which comprises a U letter ridge 12*a* extending along a circumference edge and plural of radial ridges 12*b*, 12*b* extending from the U letter ridge 12*a* to the circumference edge as shown in FIG. 2, Further, according to a second embodiment of the present invention, there is proposed a ridge structure made of homothetic polygons 21, 22 and 23 formed in a concentric multiple fashion (pentagon shown in FIG. 5*a*) and the bottom lines are faced parallel to the face surface of the head. The multiple polygons are divided by lines 24 connecting from outer aspects to inner aspects as shown in FIG. 4 (triple pentagon). Furthermore, according to a third embodiment of the present invention, there is provided a ridge structure wherein multiple circle ridges 31, 32 and 33 are arranged in a concentric multiple fashion on the surface 30 and are divided by radically extending lines 34 as shown in FIG. 5 (triple circles). Further, according to a fifth embodiment of the present invention, there is provided a ridge structure wherein multiple arrow fletchings 41*a*, 41*b*, 41*c*, 41*d*, and 41*e* are radially arranged and their circumference edges are partitioned by ridges as shown in FIG. 6 (5 arrow fletchings). The above embodiments are formed as ridge structures regularly arranged like a form of wind mill, but as shown in FIG. 7, closed spaces 51, 52 and 53 are made by ridges of arrows of lighting like almost N letter and may be arranged irregularly so as to change the inclined angle of the ridges in a clockwise direction.

The summary of this theory is as follows. 1) firstly the radially extending ridges are important to always function as an effective barrier for the air flows by changing the inclined angle of the ridges in a clockwise direction depending on the swing movement of the head. It is a condition to make an accumulated air flow between the head surface and the surrounding air. 2) Further, it is a preferred condition to make a substantially closed spaces by the radially extending ridges in order to keep the accumulated time of the air flow.

In the present invention, although the size and the pattern of the ridges are designed with the ball driving speed and the ball rotation number, it is generally preferred to have the height of 0.2 mm to 3 mm and the breadth of 1 mm to 5 mm. The space between the ridges is determined in relation to the height and the breadth. The rising front face of the ridges should be preferably designed so as to have a function of the barrier for the air flow.

The Effectiveness of the Invention

According to the invention, as shown in FIG. 3, the air flows crash against the first ridge R1 and rise up along the front wall. Then the rising air flows are pressed down into a space in front of the second ridges by the surrounding air layer and crash again against the second ridges to turn over in a reverse direction. This repeated motion made by the plural ridges generate the intermediate air flow of air whirls W between the sole surface and the surrounding layer, resulting in avoiding the surrounding air from retouching on the club-head and thus effectively decreasing the air resistance of the head.

The plural ridges R1, R2, are to press down the rising air flow after crashing against the first ridge wall onto the head surface by the outside surrounding air flow and crash again against the second ridge wall to generate a reverse flow which becomes air whirls W. It is important to repeat the motion one to another between the successive ridges. As mentioned above, the height and the breadth of the ridges may be adjusted to generate the air vortex flows or whirls between the ridges. The ridges may be constructed by the successive or intermittent linear ridges. The ridges are not limited to a linear one and may be formed successively or intermittently.

In the present invention, while the ridges may be formed just on the sole surface which is dominant to occur the air resistance, the ridges may be also formed on the crown surface of the head. In the embodiment, the crown ridges may comprise linear ridges 11*a*, 11*a* arranged parallel to the face surface and a pair of L letter ridges 11*c* orthogonal oriented on the both edges.

THE SIMPLE EXPLANATION OF THE DRAWING

FIG. 1(*c*) is a sectional view showing a state of the surrounding air flow.

FIG. 2(*b*) is a plain view showing a sole side surface of the head.

FIG. 2(*c*) is a side view of a side surface of the head showing a relation between air whirls generated on the surface and the surrounding air flows.

THE PREFERRED EMBODIMENT

Figure 1:
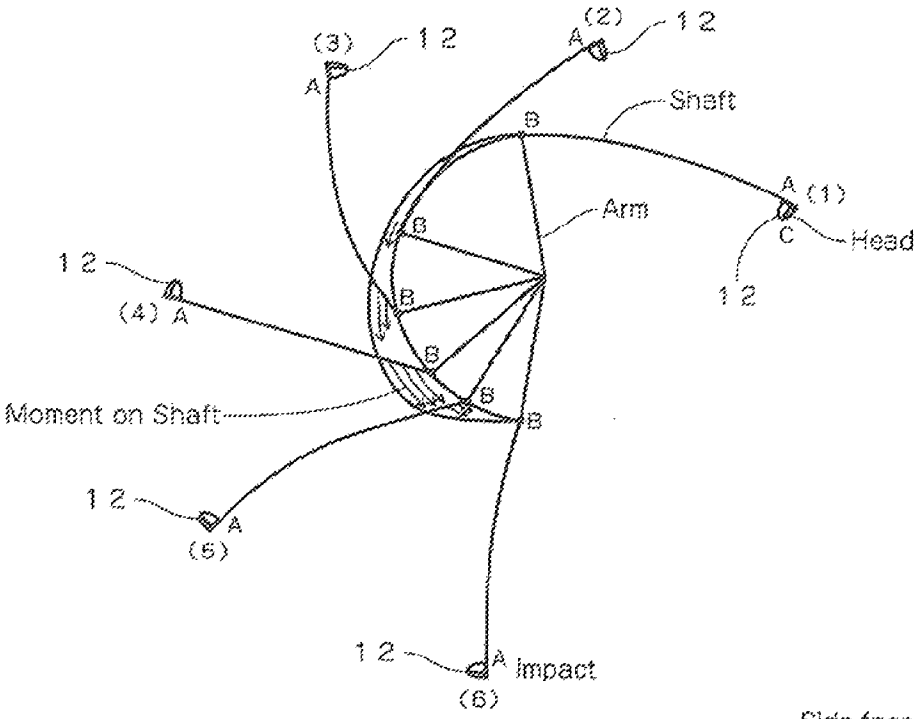
FIG. 1(*a*) is a head trajectory view of the club swing showing a relation between the bending moment and the twist moment of the shaft, FIG. 1(*b*) is a explanation view showing a relation between the shaft line and the gravity operation line.
Figure 1:
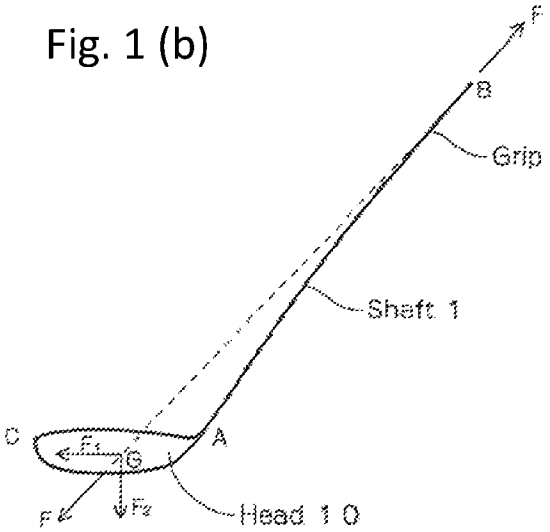
Figure 1:
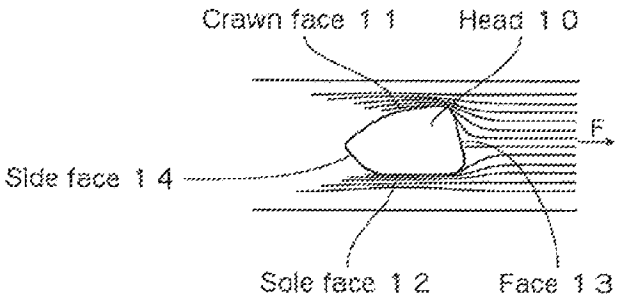

The bending moment and the twist moment generated on the shaft is generally caused by the head motion during swinging as shown in FIG. 1.

(1) At the top position of the swing, the shaft tends to be bent in an opposite direction of the gravity by the head downward motion.

(2) and (3) The bending motion generates by the action of swing power when the down swing begins.

(4) At the middle of the down swing, a reaction force generates against the bending motion and a reverse whip of the shaft starts.

(5) The reverse whip degree is increasing gradually and at the same time, the twist moment of the shaft begins to generate.

(6) At the impact, the reverse whip is getting back, whereby the edge of the head begins to toe-in.

In order to decrease the twist moment, movement of the head gravity from toe to heel has been researched. According to the present invention, we realized to decrease the twist moment and the bending moment by the air flows surrounding the head.

In case of the right-handed, the left rotation swing together with the body movement causes a twist of the shaft, because the shaft A-B between the grip A and the head B has a angle of misfitting with the line between the grip A and the gravity G, so that the gravity force impinges on a part between the gravity G and the shaft edge E. The twist moment should be decreased by synergy effect of the movement of gravity and the decrease of the air resistance of the head.

Figure 2A:
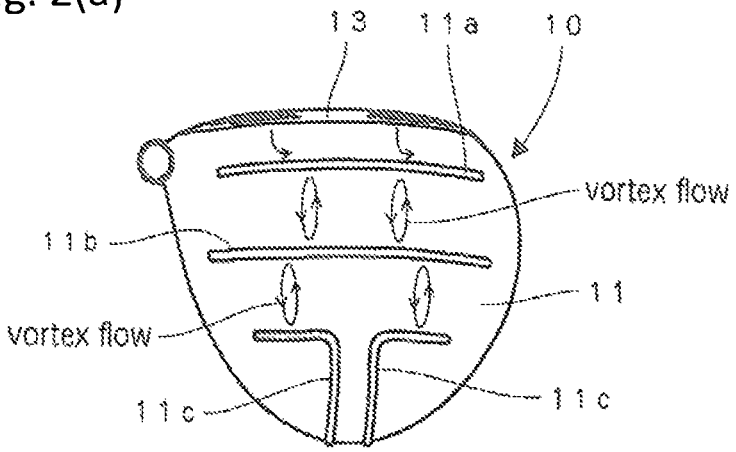
FIG. 2(*a*) is a plain view showing a crown side surface of the head.
Figure 2B:
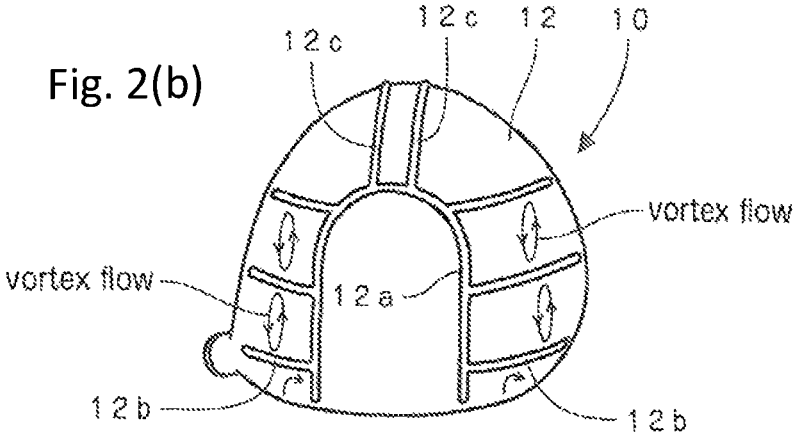
Figure 2C:
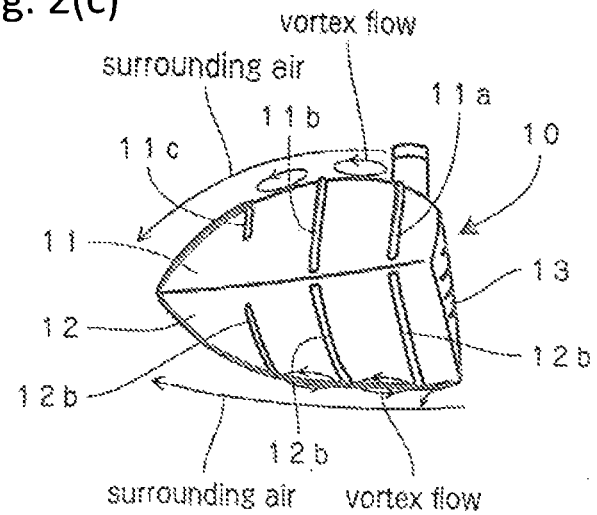
Figure 3:
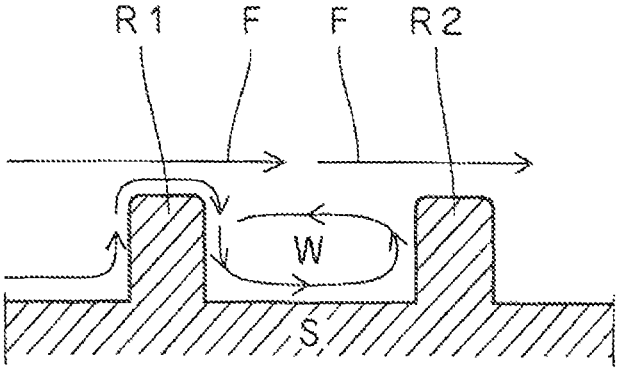
FIG. 3 is an explanation view showing a process for making air whirls on the surface.
Figure 4:
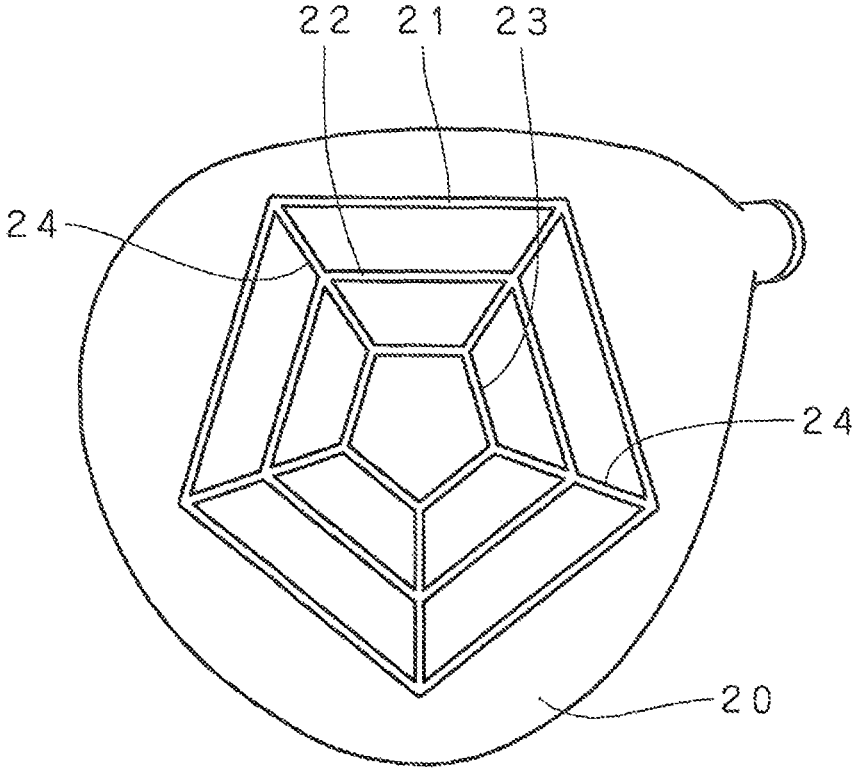
FIG. 4 is a plain view of a second ridge structure provided with multiple polyhedrons on the sole surface according to the present invention.
Figure 5:
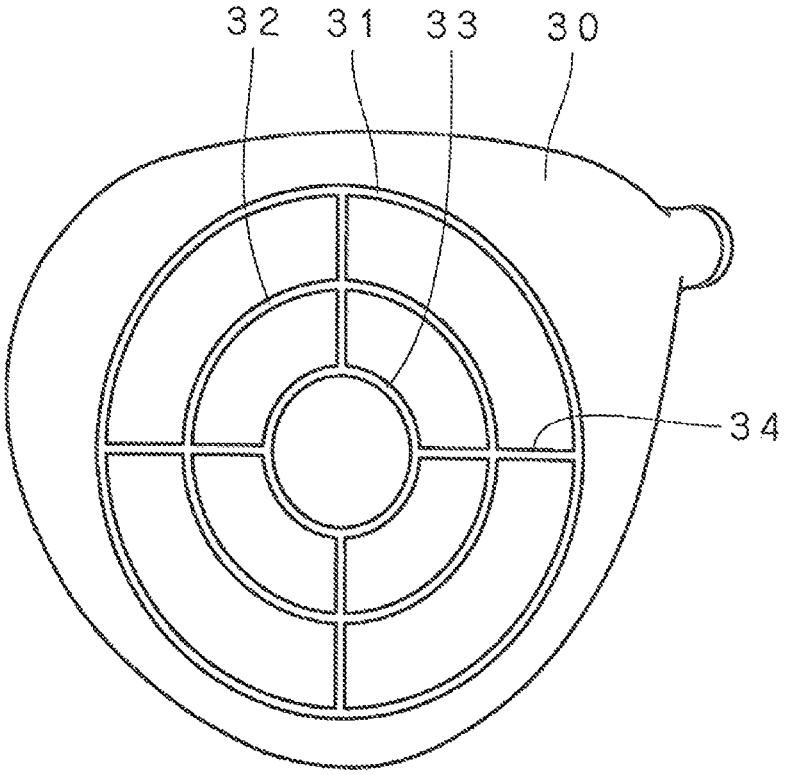
FIG. 5 is a plain view of a third ridge structure provided with multiple circles on the sole surface according to the present invention.
Figure 6:
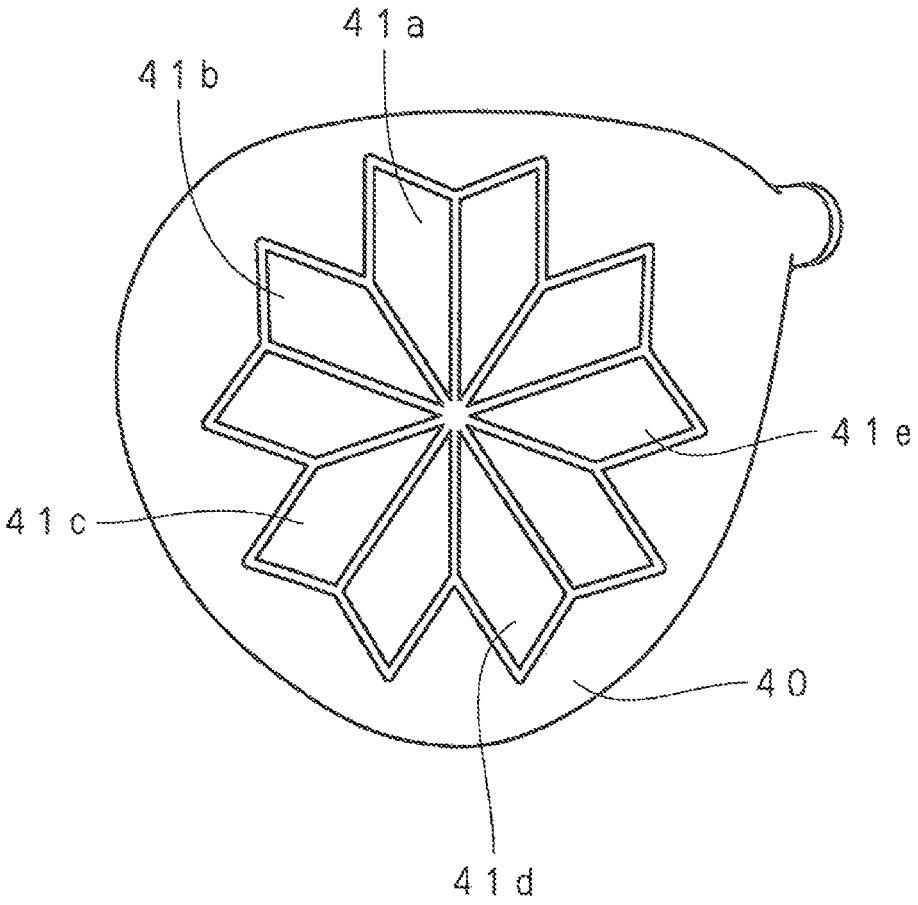
FIG. 6 is a plain view of a fourth ridge structure provided with windmill shape on the sole surface according to the present invention.
Figure 7:
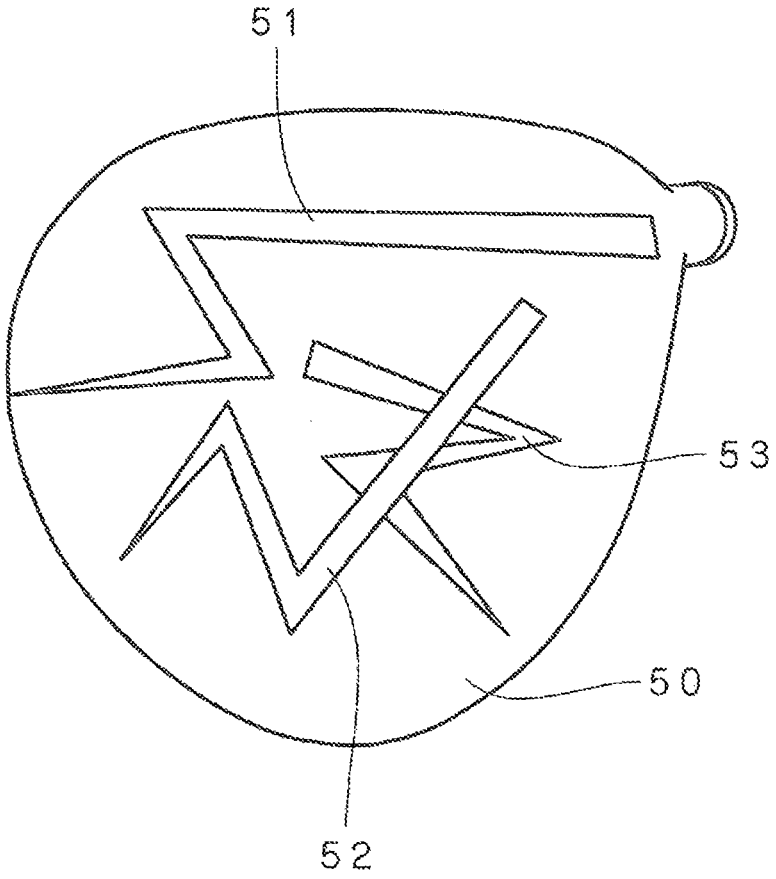
FIG. 7 is a plain view of a fifth ridge structure provided with arrows of lighting shape on the sole surface according to the present invention.

From the swing trajectory, the air resistance generated during the process (1) to (6) is not supposed to be caused by the face part because the face takes a position square to the air flows just only for a short time and a short distance between before and after the impact, totally 10% of the all swing time and distance as shown in FIG. 2. The other swing time and distance give the centrifugal force longer and much more on the head. From the trajectory of the swing motion as shown in FIG. (a), the sole part is always and dominantly contacting with the surrounding air. In the light of the fact, decrease of the all air resistance of the head can be realized simply by decrease of the air resistance of the sole part. Of course, the air resistance together with the side parts and the crown part had better to be decreased. Because the bigger the air resistance, the bigger the resulting twist of the shaft and finally the bigger the bending moment and the twist moment. The moment on the shaft tends to be proportional to an area and a time contacting with the air. The decrease of the air resistance by the dominant sole part makes the total resistance smaller. Similarly, change of the air flows from the laminar flow to turbulence flow on the side parts and the crown part makes the total air resistance much smaller. According to the present invention, the golfer can swing it more smoothly and get 10 yards or 20 yards longer driving depending on 5% more head speed.

EXAMPLE 1

According to the present invention, a golf club comprises a wood club-head and a shaft wherein the club-head is provided with a crown surface 11, on which a pair of ridges 11*a*, 11*b* are extended from a toe side to a heel side and a pair of L letter ridges 11*c*,11*c* are positioned toward a back end side of the crown as shown in FIG. 2(*a*). On the other hand, a sole surface of the head is provided with a U letter ridge 12*a* extending from a face side to a back side, from which plural ridges 12*b*,12*c* are formed in a predetermined interval and extending radially to a circumference edge as shown in FIG. 2(*b*) The radial extending ridges displace the angle direction in the light of the head face direction changing during the swing. In this example, the ridge height is 0.7 mm and the breadth is 2.7 mm which are allowable to be adjusted in the above scope. According to the embodiment, the surrounding airs can smoothly flow without retouching to the head surface by intermediate air whirls between the surrounding air flows and the crown and sole surfaces as shown in FIG. 2(*c*).

According to the preferred embodiment, the outside surrounding air layer presses down upcoming air flows after crashing against the first ridge and then the pressed air flows cross over the first ridges into the space in front of the second ridges and crash again against the second ridges to generate back flows. These repeated actions makes air whirls between the surrounding air layer and the head surface, whereby the air resistance of the head can be decreased by avoiding the surrounding air from retouching on the club-head surface.

In the embodiment of the invention, the ridges may generally be formed as a linear ridge parallel to the face surface on the crown surface with the height of 0.2 mm to 3 mm and the breadth of 1 mm to 5 mm. According to the present invention, the ridge shape can not limited to the linear ones. It is important that the ridge shape should be configured to have a function to make air whirls between the space between the first and the second ridges by repeat of the action of the air flows crashing against the ridges to generate back flows. The height and intervals of the ridges may be adjusted so as to generate air whirls between the space between the first and the second ridges, which is not limited to the linear ones.

The invention claimed is:

1. A golf-club comprising:

a club-head including a face at which the club-head is arranged to collide in a first direction with a golf ball, a sole, and a ridge structure being on a surface of the sole, the ridge structure including a plurality of first ridges and a plurality of second ridges arranged at an interval, and a U shaped ridge from which the plurality of first ridges and the plurality of second ridges extend outwardly, the plurality of first ridges extending parallel to the first direction and the plurality of second ridges extending in a second direction perpendicular to the first direction, the interval being larger than a width of each of the plurality of the first ridges.

2. The golf-club according to claim 1, wherein the first plurality of ridges and the second plurality of ridges make a substantially enclosed space.

3. The golf-club according to claim 1, wherein each of the first and second plurality of ridges has a height of 0.2 mm to 3 mm and a breadth of 1 mm to 5 mm.

4. The golf-club according to claim 1, wherein the first and second plurality of ridges protrude perpendicularly with respect to the surface of the sole.

5. The golf-club according to claim 1, wherein the first and second plurality of ridges are linearly formed, and successively or intermittently formed.

* * * * *